United States Patent [19]

Evans

[11] 4,062,612

[45] Dec. 13, 1977

[54] ELECTRICAL FEEDTHROUGH DEVICES

[75] Inventor: David Roger Evans, Petersfield, England

[73] Assignee: Sealectro Corporation, Mamaroneck, N.Y.

[21] Appl. No.: 740,091

[22] Filed: Nov. 9, 1976

[30] Foreign Application Priority Data

Nov. 14, 1975 United Kingdom ..... 47072/75

[51] Int. Cl.[2] ..... H01R 7/02

[52] U.S. Cl. ..... 339/94 A; 339/131; 29/629

[58] Field of Search ..... 29/432, 629; 174/151, 174/152 GM; 339/94 A, 131, 177

[56] References Cited

U.S. PATENT DOCUMENTS

| | | | |
|---|---|---|---|
| 1,960,938 | 5/1934 | Forbes | 174/151 |
| 3,200,366 | 8/1965 | Stuart | 339/94 A |
| 3,678,446 | 7/1972 | Siebelist | 339/177 E |

*Primary Examiner*—Gerald A. Dost
*Attorney, Agent, or Firm*—Anthony J. Casella

[57] ABSTRACT

An electrical feedthrough capable of connecting electrical components on opposite sides of a bulkhead includes a feedthrough housing having hermetically sealed therein a hermetic sub-assembly consisting of an electrical conductor concentrically disposed within a dielectric body which, in turn, is disposed within a conductive sleeve. The hermetic sub-assembly is sealed to the feedthrough housing by a flange which projects outwardly relative to the conductive sleeve, and which flange is physically deformed against the internal surface of the feedthrough housing. In the method for making the electrical feedthrough according to the invention, the connecting component is hermetically sealed within the connector body physically deforming a flange projecting outwardly relative to the conductive sleeve against an internal surface of the feedthrough housing.

12 Claims, 12 Drawing Figures

ELECTRICAL FEEDTHROUGH DEVICES

This invention relates to electrical feedthrough devices and to electrical connectors incorporating such feedthrough devices.

The invention relates more particularly to an electrical feedthrough having a component comprising a conductive sleeve, a conductor extending longitudinally within the sleeve, and a dielectric body around the conductor.

The invention also concerns a method of assembling such feedthrough devices.

BRIEF DESCRIPTION OF THE DRAWINGS

FIGS. 1*a* and 1*b* of the accompanying drawings illustrate in transverse and longtudinal section respectively, a feedthrough which incorporates these basic features in one particular form, namely that of a coaxial feedthrough having a circular cylindrical sleeve 1, and, extending axially within the sleeve an elongate conductor 3 which is fixed by means of a dielectric body 2 of annular cross section. The conductor 3 may, as shown in the longitudinal section of FIG. 1*b* project beyond the two opposite ends of the dielectric body 2, for connection to an appropriate complementary connecting element.

FIG. 1*c* shows, in longitudinal cross section, a connecting component of the coaxial type, the conductor 3 of which is hermetically sealed within the dielectric body 2, which, in turn is hermetically sealed within the sleeve 1, the sealed component 4 (hereinafter referred to generically as a hermetic sub-assembly) so formed being known as a thimble seal. A hermetic sub-assembly of this type may take various forms, but the general purpose of all forms is to transmit direct, alternating or other periodic voltages and currents between two transmissions or other electrical devices which may, or may not be separated by a bulkhead.

Figure 2:
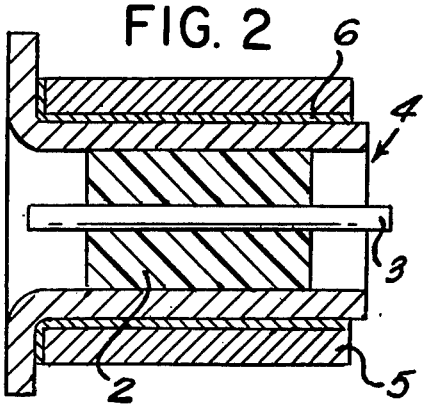
FIG. 2 shows a sub-assembly sealed in a body.

Existing techniques of preparing hermetically sealed feedthroughs in which a separate hermetic sub-assembly 4 (FIG. 2) is itself sealed into a body 5 suffer from the disadvantage that the means used to seal the hermetic sub-assembly 4 into the body 5 by soldering or brazing, (the additional material is shown at 6) render the manufacture difficult and inefficient, and can introduce undersirable internal stresses in the dielectric body as a result of the high temperatures employed.

An object of the invention is to alleviate these disadvantages.

According to the invention there is provided an electrical feedthrough comprising a feedthrough housing and, hermetically sealed therein, a hermetic sub-assembly including a conductive sleeve and, disposed within the sleeve a dielectric body carrying a conductor which extends longitudinally of the sleeve, wherein the hermetic sub-assembly is sealed to the feedthrough housing by a flange which projects outwardly relative to the sleeve, and which is physically deformed against an internal surface of the feedthrough housing.

According to the invention there is also provided a method of making an electrical feedthrough comprising disposing within a feedthrough housing a hermetic sub-assembly including a conductive sleeve and disposed within the sleeve a dielectric body carrying a conductor which extends longitudinally of the sleeve, and hermetically sealing the connecting component within the connector body by physically deforming a flange projecting outwardly relative to the sleeve against an internal surface of the feedthrough housing.

Preferably the deformation of the flange is caused by a partial shearing of an outer edge region thereof against an edge of a step provided in the internal surface of the feedthrough housing. The flange may be formed integrally with the conductive sleeve of the hermetic sub-assembly, the partial shearing being caused by trapping the edge of the flange between the said step and a stepped portion on a sealing member moveable within the feedthrough housing and by forcing said sealing member inwardly of the feedthrough housing. Alternatively, the flange may be constituted by a separate deformable shear ring, the partial shearing being caused by trapping this ring between the step and a stepped portion on the outer surface of the sleeve of the sub assembly, and forcing the sub-assembly inwardly of the feedthrough housing, possibly with the aid of a thrust member moveable within the feedthrough housing. The feedthrough housing may comprise a tube within which is disposed the hermetic sub-assembly, the sealing or the thrust member comprising an assembly bush disposed about the said sub-assembly within the tube.

Embodiments of the invention will now be described by way of example, with reference to FIGS. 3 to 6 of the accompanying drawings in which:

FIGS. 3*a*, 4*a*, 5*a* and 6*a* are longitudinal partly cross-sectional views illustrating the assembling of feedthrough devices according to the invention, and FIGS. 3*b*, 4*b*, 5*b* and 6*b* are longitudinal partly cross-sectional views each showing part of the components shown in the respective one of FIGS. 3*a* to 6*a*, and illustrate the different ways in which hermetic seals can be effected according to the invention.

Figure 1A:
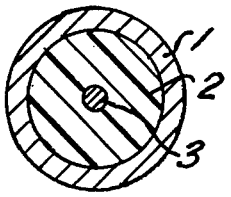
FIGS. 1*a* and 1*b* of the accompanying drawings illustrate in transverse and longitudinal section respectively.
Figure 1B:
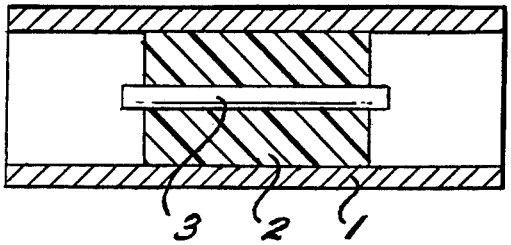
Figure 1C:
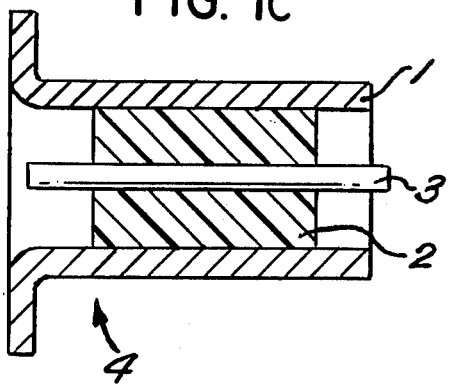
FIG. 1*c* shows, in longitudinal cross section, a connecting component of the coaxial type.
Figure 3A:
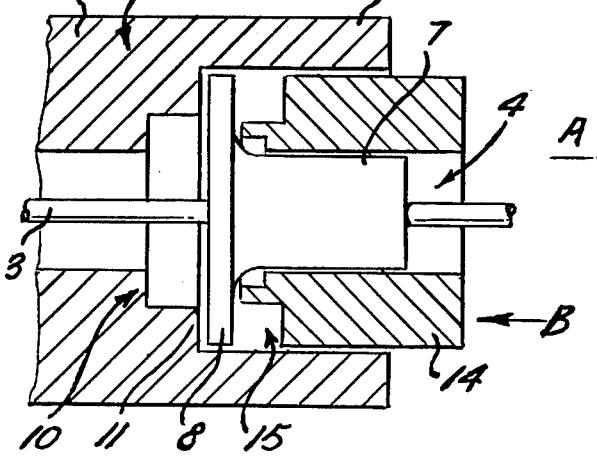
FIGS. 3*a*, 4*a*, 5*a* and 6*a* are longitudinal partly cross-sectional views illustrating the assembling of feedthrough devices according to the invention.

With reference to FIG. 3*a* a hermetic sub-assembly 4 incorporates the basic features of a thimble seal as illustrated in FIG. 1*c*, the outer conductive sleeve having a cylindrical portion 7 and at one end thereof an integrally formed, outwardly projecting annular flange 8, and the conductor 3 extending coaxially within the cylindrical portion 7. The sleeve is in this embodiment constructed of a suitably ductile metal for instance copper.

Figure 3B:
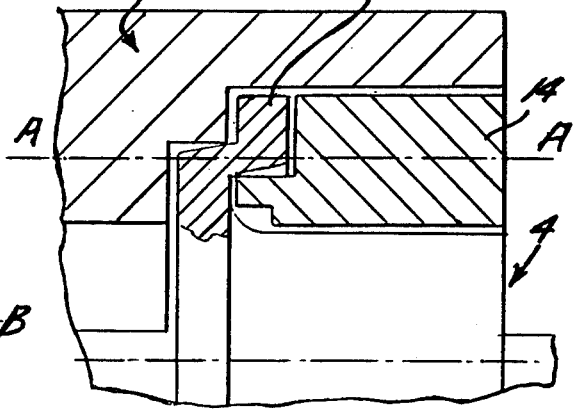
FIGS. 3*b*, 4*b*, 5*b* and 6*b* are longitudinal partly cross-sectional views each showing part of the components shown in the respective one of FIGS. 3*a* to 6*a*.

The hermetic sub-assembly 4 is to be mounted within a feedthrough housing which in this embodiment compromises a conductive tube 9 on whose inner surface is machined an annular step 10 having an edge 11, the step separating a larger diameter part 12 of the tube 9 from a smaller diameter part 13, and a sealing member in the form of an assembly bush 14 which is slidable axially within the larger diameter part 12 and at its inner end has a stepped portion 15 for cooperation with the annular step 10 as described below. The assembly bush 14 has internal dimensions which are sufficient to allow it to accommodate the hermetic sub-assembly 4, whilst the external diameter of the flange 8 is somewhat greater than the internal diameter of the smaller diameter part 13. During assembly of the feedthrough the hermetic sub-assembly is inserted into the larger diameter part of the tube 9 in the direction of arrow B, until the outer edge of the flange 8 abuts the step 10 as shown in FIG. 3*a*. The assembly bush 14 is then forced into the tube 9 in the direction of the arrow B, and the outer part of the flange 8 becomes trapped between the step 10 and the stepped portion 15, is forced against the edge 11, and is thereby caused partially to shear about the line A—A as shown in FIG. 3*b*. This shearing forms a hermetic seal, or shear seal, between the flange 8 and the tube 9, whereby the assembly of the hermetic sub-assembly 4 and the feedthrough housing forms a hermetically sealed feedthrough.

Figure 4A:
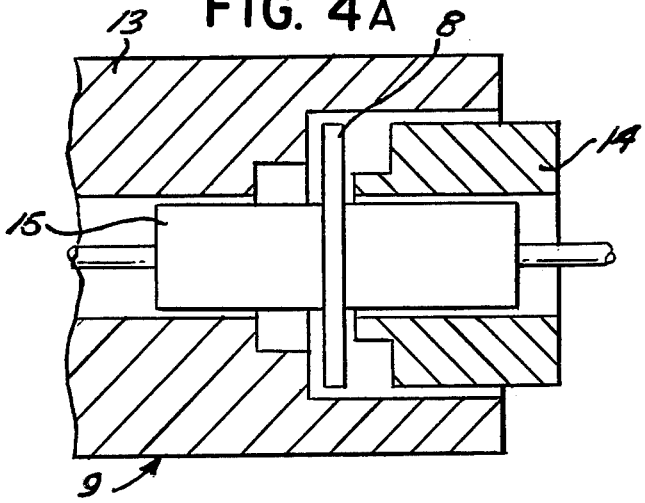
Figure 4B:
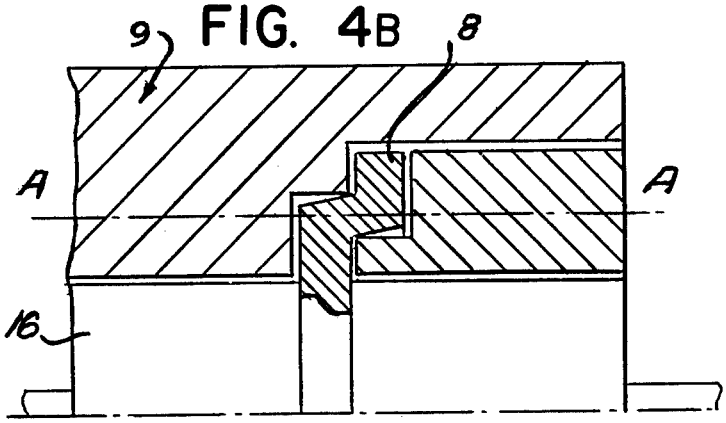

In the embodiment illustrated in FIGS. 4*a* and 4*b*, the flange 8 is again integrally formed with the outer sleeve of the hermetic sub-assembly 4, but projects not from the end of the cylindrical portion 7 but from an intermediate point along its length, so that in the assembled feedthrough a part 16 of the sleeve extends within the smaller diameter part 13 of the tube 9.

Figure 5A:
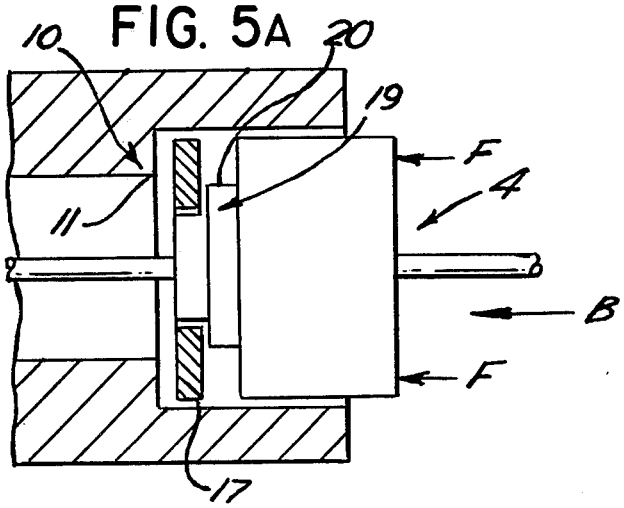
Figure 5B:
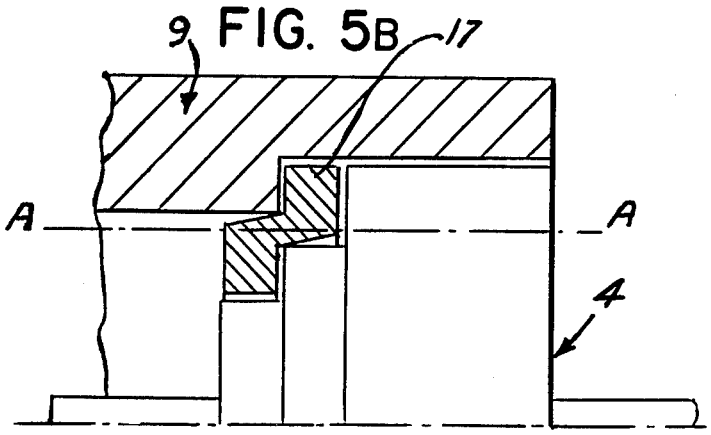
Figure 6A:
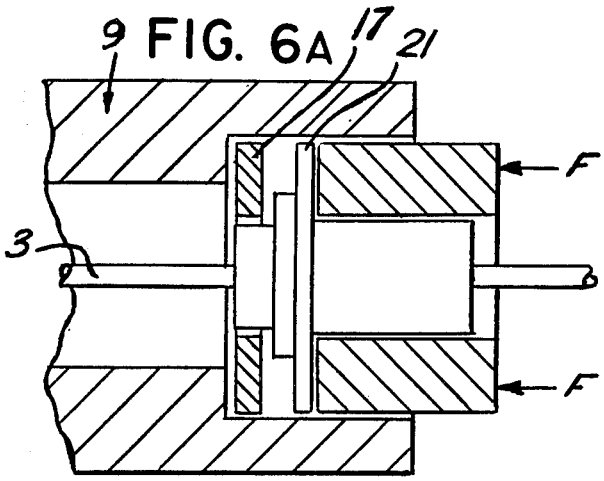
Figure 6B:
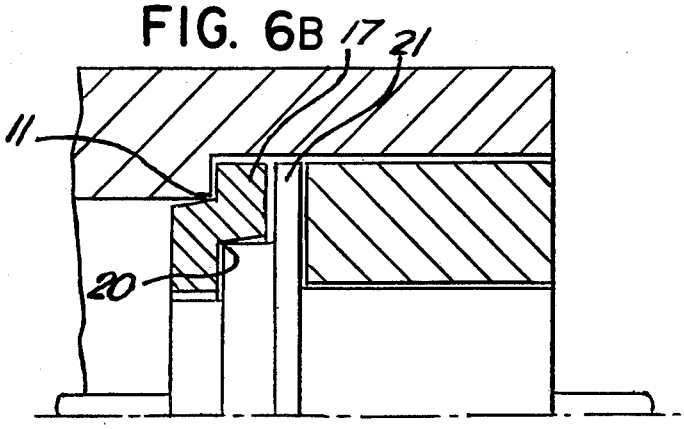

In the embodiments illustrated in FIGS. 5*a*, 5*b* and 6*a*, 6*b* the flange is constituted by a shear ring 17 of deformable material, such as p.t.f.e. and encircling the sub-assembly. An annular step 10 is again machined on the inner surface of the tube 9 constituting the feedthrough housing, but here the outer sleeve of the mermetic sub-assembly is integrally formed with an annular stepped portion 19 defining a shearing edge 20. During assembly of the feedthrough the shear ring 17 is trapped between the step 10 and the stepped portion 19, and the hermetic sub-assembly is forced inwardly of the feedthrough housing in the direction of arrow B partially to shear the shear ring about line A—A between the edges 11 and 20 as shown in FIGS. 5*b* and 6*b* to effect the required hermetic seal.

The shearing force F may be applied to the hermetic sub-assembly itself if, as in FIGS. 5*a*, 5*b*, if this is sufficiently strong to withstand the longitudinal compressive forces without becoming damaged. Alternatively the shearing force F may be applied by way of an assembly bush 14 forming a thrust member which encloses the cylindrical part 7 of the sleeve 1 and which abuts a shearing collar 21 integrally formed on and projecting outwardly from the sleeve 1 of the hermetic sub-assembly and providing the shearing of edge 20.

The above described methods of assembly clearly provide a simpler and more efficient technique of producing a hermetically sealed feedthrough than the known methods involving soldering or brazing.

The feedthrough produced by any of the above techniques may be incorporated in any of a wide variety of connecting assemblies, such as a coaxial connector.

The hermetic sub-assembly used in any of the above techniques may itself be constituted by a feedthrough produced by a similar technique.

Although the method employed for hermetically sealing the dielectric body 2 to the conductor 3 and to the sleeve 1 does not form part of the present invention, it should be mentioned that a technique as disclosed and claimed in our copending patent application Ser. No. 740,092 filed Nov. 9, 1976, may be used. This technique involves the physical deformation of outwardly and/or inwardly projecting parts of a flange provided on the dielectric body against the sleeve and/or the conductor respectively.

Alternatively the hermetic seal may be made by fusion and the material of the dielectric may be a foamed glass or ceramics material, as discussed more fully and claimed in our copending patent application Ser. No. 740,093 filed Nov. 9, 1976.

The embodiments of the invention, in which an exclusive property or privilege is claimed, are defined as follows:

1. An electrical feedthrough comprising a feedthrough housing and, hermetically sealed therein, a hermetic sub-assembly including a conductive sleeve and, disposed within the sleeve a dielectric body carrying a conductor which extends longitudinally of the sleeve, wherein the hermetic sub-assembly is sealed to the feedthrough housing by a flange which projects outwardly relative to the sleeve, and which is physically deformed against an internal surface of the feedthrough housing, with the deformation of the flange comprising a partial shearing thereof against an edge formed by a peripheral step provided on the internal surface of the feedthrough housing.

2. An electrical feedthrough according to claim 1 wherein the flange is integrally formed with the conductive sleeve of the hermetic sub-assembly.

3. an electrical feedthrough according to claim 2 wherein the partial shear of the flange lies between the peripheral step and a complementary stepped portion of a sealing member disposed within the feedthrough housing.

4. An electrical feedthrough according to claim 3 wherein the sealing member comprises a bush disposed about a part of the sleeve and having said complementary stepped portion formed at one end thereof.

5. An electrical feedthrough according to claim 4 wherein the flange projects at one end of the sleeve.

6. An electrical feedthrough according to claim 4 wherein the flange projects at an intermediate point on the sleeve.

7. An electrical feedthrough according to claim 1 wherein the flange comprises a shear ring about the hermetic sub-assembly.

8. An electrical feedthrough according to claim 7 wherein the partial shear of the shear ring lies between the peripheral step and a complementary stepped portion on the outer surface of the conductive sleeve of the hermetic sub-assembly.

9. An electrical feedthrough according to claim 8 wherein the sleeve is integrally formed with a shearing collar which provides said complementary stepped portion.

10. An electrical feedthrough according to claim 9 and including a thrust member in the form of a bush disposed about a part of the sleeve and abutting the shearing collar.

11. An electrical feedthrough according to claim 1 wherein the hermetic sub-assembly itself comprises the electrical feedthrough, and the feedthrough housing thereof constitutes the conductive sleeve.

12. A method of making an electrical feedthrough comprising disposing within a feedthrough housing a hermetic sub-assembly including a conductive sleeve and disposed within the sleeve a dielectric body carrying a conductor which extends longitudinally of the sleeve, and hermetically sealing the connecting component within the connector body by physically deforming by partial shearing a flange projecting outwardly relative to the sleeve against an internal surface of the feedthrough housing.

* * * * *